US008459951B2

(12) United States Patent
Arrell et al.

(10) Patent No.: US 8,459,951 B2
(45) Date of Patent: Jun. 11, 2013

(54) ROTOR FOR AN AXIAL FLOW TURBOMACHINE

(75) Inventors: Douglas J. Arrell, Oviedo, FL (US); Harald Hoell, Wächtersbach (DE); David W. Hunt, Orlando, FL (US); Karsten Kolk, Mülheim a.d. Ruhr (DE); Harald Nimptsch, Essen (DE)

(73) Assignee: Siemens Aktiengesellschaft, München (DE)

( * ) Notice: Subject to any disclaimer, the term of this patent is extended or adjusted under 35 U.S.C. 154(b) by 494 days.

(21) Appl. No.: 12/672,794

(22) PCT Filed: Aug. 8, 2008

(86) PCT No.: PCT/EP2008/060480

§ 371 (c)(1),
(2), (4) Date: Feb. 9, 2010

(87) PCT Pub. No.: WO2009/021927

PCT Pub. Date: Feb. 19, 2009

(65) Prior Publication Data

US 2011/0318184 A1 Dec. 29, 2011

(30) Foreign Application Priority Data

Aug. 10, 2007 (EP) ..... 07015785

(51) Int. Cl.
*F01D 5/06* (2006.01)

(52) U.S. Cl.
USPC ..... 416/201 R; 416/215; 415/199.4

(58) Field of Classification Search
USPC ..... 416/193 A, 198 A, 200 A, 201 R, 416/201 A, 215; 415/199.4, 199.5
See application file for complete search history.

(56) References Cited

U.S. PATENT DOCUMENTS

| | | | | |
|---|---|---|---|---|
| 5,632,600 | A * | 5/1997 | Hull | 416/198 A |
| 5,860,789 | A * | 1/1999 | Sekihara et al. | 416/201 R |
| 6,094,905 | A | 8/2000 | Fukuyama | |
| 6,283,712 | B1 * | 9/2001 | Dziech et al. | 416/179 |
| 6,416,276 | B1 * | 7/2002 | Marmilic et al. | 415/178 |
| 6,514,038 | B2 * | 2/2003 | Akiyama et al. | 415/116 |

FOREIGN PATENT DOCUMENTS

| | | | |
|---|---|---|---|
| CH | 238207 | A | 6/1945 |
| DE | 898100 | C | 11/1953 |
| DE | 972310 | C | 2/1958 |
| DE | 972310 | C | 7/1959 |
| DE | 19914227 | B4 | 5/2007 |
| EP | 0846844 | A1 | 6/1998 |
| EP | 0921273 | A1 | 8/1999 |

(Continued)

*Primary Examiner* — Edward Look
*Assistant Examiner* — Justin Seabe

(57) ABSTRACT

A rotor for an axial flow turbomachine is provided. The rotor includes a plurality of rotor discs that are arranged in stacks and clamped together with at least one tie rod. At least one of the rotor discs of the rotor comprises a smaller outer diameter than one of the neighboring rotor discs and that the difference in diameter is compensated by a drum surrounding the rotor disc with the smaller outer diameter as a ring. The drum may be made of a heat resistant material. The rotor discs surrounded by the drum may be made of a less expensive material. Furthermore, the drum may include at least one more blade ring than the rotor discs that are surrounded by the drum.

19 Claims, 3 Drawing Sheets

FOREIGN PATENT DOCUMENTS

| | | | |
|---|---|---|---|
| EP | 1672172 | A1 | 6/2006 |
| FR | 2566835 | A1 | 1/1986 |
| GB | 602656 | A | 6/1948 |
| GB | 755290 | A | 8/1956 |
| RU | 2033525 | C1 | 4/1995 |
| SU | 6926546 | | 10/1979 |

* cited by examiner

ROTOR FOR AN AXIAL FLOW TURBOMACHINE

CROSS REFERENCE TO RELATED APPLICATIONS

This application is the US National Stage of International Application No. PCT/EP2008/060480, filed Aug. 8, 2008 and claims the benefit thereof. The International Application claims the benefits of European Patent Office application No. 07015785.4 EP filed Aug. 10, 2007. All of the applications are incorporated by reference herein in their entirety.

FIELD OF INVENTION

The invention refers to a rotor for a turbomachine which is exposable to axial throughflow, with a plurality of rotor disks which are arranged in a stacked manner, are axially clamped to each other by means of at least one tie rod and have an outside diameter in each case.

BACKGROUND OF INVENTION

Generic-type rotors have been known for a long time from the general prior art. As is known, the rotor disks which are used in the rotor carry rotor blades, which are arranged in a ring, on their outer sides, by means of which an operating medium is compressible or by means of which the energy which is contained in an operating medium can be converted into the rotational movement of the rotor. The stacked rotor disks, which abut against each other, in this case are clamped to each other by at least one tie rod. For this purpose, the tie rod extends through the rotor disks and is pretensioned by means of nuts which are screwed on at the ends. The tie rod ensures the tight abutting of the rotor disks against each other.

It is further known from DE 199 14 227 B4 that a welded-together rotor can have an outer, drum-like, thermal protective cover for protecting the internal region of the rotor.

In addition, a cooled gas turbine rotor is known from patent specification DE 898 100. Its outer periphery is formed by annular blade carriers which are provided with oppositely-disposed recesses towards the axis. In each of these recesses a projecting edge of a rotor disk engages in each case so that the respective blade carrier is clamped in a form-fitting manner between two rotor disks.

Furthermore, a drum rotor,—which is assembled from a plurality of parts, for gas turbines is known from patent specification CH 238 207. The drum rotor in this case comprises drum which is axially assembled from a plurality of rings which are welded to each other on the outer drum periphery at the abutment points. In this case, the edge of a rotor disk is enclosed in a form-fitting manner between two adjacent rings in the region of the abutment points.

A modular rotor for a turbomachine in disk type of construction is known from patent specification DE 972 310. The rotor blades which are carried by the rotor are fastened in detail on rings. The rings by their end faces are retained by means of form fit by rotor disks which are arranged on both sides.

According to general efforts to increase efficiency and output of gas turbines which are used for generating energy, comparatively large compressor mass flows with simultaneously high compressor pressure ratios are required. Greater compressor mass flows occur for example in the case of compressors of gas turbines, the nominal output of which is more than 50 MW. The compressor pressure ratio is greater than 1:16 in this case. On account of the comparatively high pressure ratio the temperature of the compressed air rises to several hundred degrees Celsius. The high air temperature heats up the adjacent elements of the compressor, especially in the region of the rear compressor stages, so that nowadays the previously used materials can no longer adequately withstand the temperatures which occur now on account of the increased pressure ratios. When using more temperature-resistant materials for rotor disks, however, further disadvantages in strength and machinability emerge on account of the overall size of compressors with large mass flows so that these materials are suitable only to a limited extent and can be used only to a limited extent. Moreover, the more temperature-resistant materials are also more expensive.

SUMMARY OF INVENTION

The object of the invention is therefore the provision of a rotor for a turbomachine which is exposable to axial throughflow, preferably for a high-pressure compressor with a pressure ratio of more than 1:16 and a comparatively large compressor mass flow, in which while maintaining the concept with rotor disks which abut against each other in a stacked manner an inexpensive construction can be specified. At the same time, the rotor is to have a particularly long service life. In addition, the efficiency of the compressor is to be further improved.

The aforesaid objects are achieved by means of a rotor of the type referred to in the introduction, in which at least two of the rotor disks of the rotor have a smaller outside diameter than one of the adjacent rotor disks and the existing diameter difference is compensated by means of a drum which annularly encompasses the rotor disk with smaller outside diameter, which drum encompasses the rotor disks in question with small diameter over their entire axial extent and on its inner surface has an endlessly encompassing web which is axially clamped between the encompassed rotor disks with smaller diameter.

According to the invention, therefore, a multipart rotor, as seen in its radial direction, is proposed, in which the inner rotor disks can be produced from a different material than the drum which is provided on the outside. The most suitable materials can therefore be selected for the different loads of drum and rotor disks. Therefore, both the drum and the encompassed rotor disks with smaller diameter can be manufactured in each case from a material with which a particularly long service life of the components can be achieved. At the same time, a device is disclosed by means of which the drum can be connected in a rotationally fixed manner to the rotor disks of smaller diameter. A slip-afflicted relative movement between drum, which is arranged on the outside, and rotor disks, which are arranged radially further inside, is therefore not possible, as a result of which the torque and forces which are to be transmitted between the components concerned can altogether be transmitted without losses. Further more, the drum enables the sealing of gaps between the two rotor disks so that a possibly existing leakage flow at this point in the case of the prior art can be prevented here. This increases the efficiency of the compressor.

Furthermore, the rotor disks, on account of their reduced diameter, can also be better inspected for possibly existing material flaws, defects and/or cracks by means of the known ultrasound method than the rotor disks with a larger diameter which are known from the prior art.

Advantageous developments are disclosed in the dependent claims.

According to a first advantageous development, the rotor disk with the larger outside diameter is arranged directly next to the rotor disk with the smaller outside diameter. In this respect the rotor blades are hooked directly into the rotor disk with larger diameter, whereas in the axial section of the rotor in which the rotor disk with smaller diameter is arranged the rotor blades are hooked directly into the drum. The rotor, so to speak, comprises a first section with a disk rotor and a second section with a drum rotor with inner rotor disks.

According to a further advantageous development, the web of the drum extends radially further inwards than the rotor disk with smaller outside diameter and in this case has such an axial width that the web extends at least partially into a hub opening of the rotor disk with smaller diameter. This development leads to a both mechanically and thermally particularly loadable drum.

The two outer of the rotor disks, as seen in the axial direction of the rotor, which are encompassed by the drum are preferably hooked into this for absorbing centrifugal force loads. The drum therefore encompasses at least two rotor disks, wherein the two outer rotor disks, as seen in the axial direction, provide in each case a hooking arrangement on their outer peripheries in each case which can be brought into engagement in each case with a hook or slot which is correspondingly provided on the inner side of the drum. The direction of the hooking arrangement is selected so that the centrifugal force loads from the rotor disks which act upon the drum can be at least partially absorbed. As a result of this, the centrifugal force load which occurs in this section of the rotor can be distributed uniformly from the drum to the rotor disks which are arranged radially further inside. On account of the necessary installability of the stackable construction with rotor disks which are arranged radially on the inside and drum which is arranged radially on the outside it is necessary for at least the two outer rotor disks to be hooked into the drum. In an arrangement in which the drum encompasses only two rotor disks, the two rotor disks are therefore hooked into the drum.

According to a particularly advantageous development of the invention, the drum is formed from a more heat-resistant material than the rotor disks. In particular, as a result of this an especially cost-effective rotor can be disclosed since the more heat-resistant and more cost-intensive material is to be used only for the drum. The construction according to the invention is preferably used in the rear stages of an axial compressor, in which stages particularly high temperatures in the region of more than 400° C. occur during the compression process. With a more heat-resistant drum, the service life of the rotor can be at least maintained, if not further extended. Since in the inside of the rotor a lower temperature prevails than in the air which is to be compressed on account of the temperature gradients in the drum material, it can be sufficient for the rotor disks to be manufactured from a material which suffices for lower requirements with regard to temperature resistance. Consequently, the material of the rotor disks can be a more cost-effective one than the material of the drum. For example, the drum can be produced from a nickel-based alloy and the rotor disks which are encompassed by it can be produced from a heat-resistant steel or alloy.

In order to be able to disclose a particularly rigid and reliable connection between the drum and the rotor disks, the web has two oppositely disposed flange-like end faces which abut against flange-like end faces of rotor disks which are adjacent to them. The end face of the rotor disks preferably abuts in a form-fitting manner against the end face of the web. The form fit can be produced for example by means of a Hirth toothing. According to a further development, provision can be made for the drum to have at least one slot for accommodating at least one rotor blade. The slot is preferably formed as a circumferential slot so that all the rotor blades of a rotor blade ring can be inserted into the circumferential slot. The use of circumferential slots enables a particularly large number of rotor blades per ring. Furthermore, the circumferential slots are more cost-effective in their production than slots for rotor blades which extend in the axial direction.

In an especially preferred variant of the invention, the number of circumferential slots can be greater than the number of rotor disks which are encompassed by the drum. It was previously the case in the prior art that one rotor disk with a circumferential slot was provided per rotor blade stage. This necessitated a comparatively large axial installation space for fastening the rotor blades on the rotor. With the solution which is proposed now, despite the use of the modular rotor concept with rotor disks, a comparatively short axial installation space for the rotor and for the casing can be achieved since for example when using two rotor disks it is possible to provide three circumferential slots on the outer periphery of the drum, into which rotor blades of different blade rings can be inserted in each case. Therefore, axial installation space can be saved which in particular reduces the casing material costs. Moreover, the mass of the rotor can be reduced. Overall, therefore, the outer side of the drum is designed for accommodating rotor blades which are arranged in rings, wherein the number of installable blade rings can be greater than the number of rotor disks which are encompassed by the drum.

The invention is especially expedient if the rotor is used in a compressor with a pressure ratio of more than 1:16, wherein the compressor is preferably the compressor of a stationary gas turbine which is used for power generation. The nominal output of the gas turbine is preferably more than 50 MW. In this case, the invention can be used in principle in each section of a compressor. Since the problems which are referred to in the prior art occur particularly in the case of large rotor disks with an outside diameter of 1200 mm and more, it is especially advantageous if in particular such large rotor disks are replaced by the construction according to the invention with compressor disks of smaller outside diameter and with a drum which encompasses these. Preferably, therefore, the drum according to the invention also has an outside diameter of 1200 mm and more. Naturally, the invention can also be used in the sections of the compressor where, if only compressor disks without a drum would be used, these would have an outside diameter smaller than 1200 mm. Therefore, drum outside diameters of less than 1200 mm are also possible.

BRIEF DESCRIPTION OF THE DRAWINGS

The invention is explained in more detail with reference to a drawing. Further features and also further advantages result from the figure description. In the drawing.

DETAILED DESCRIPTION OF INVENTION

Figure 1:
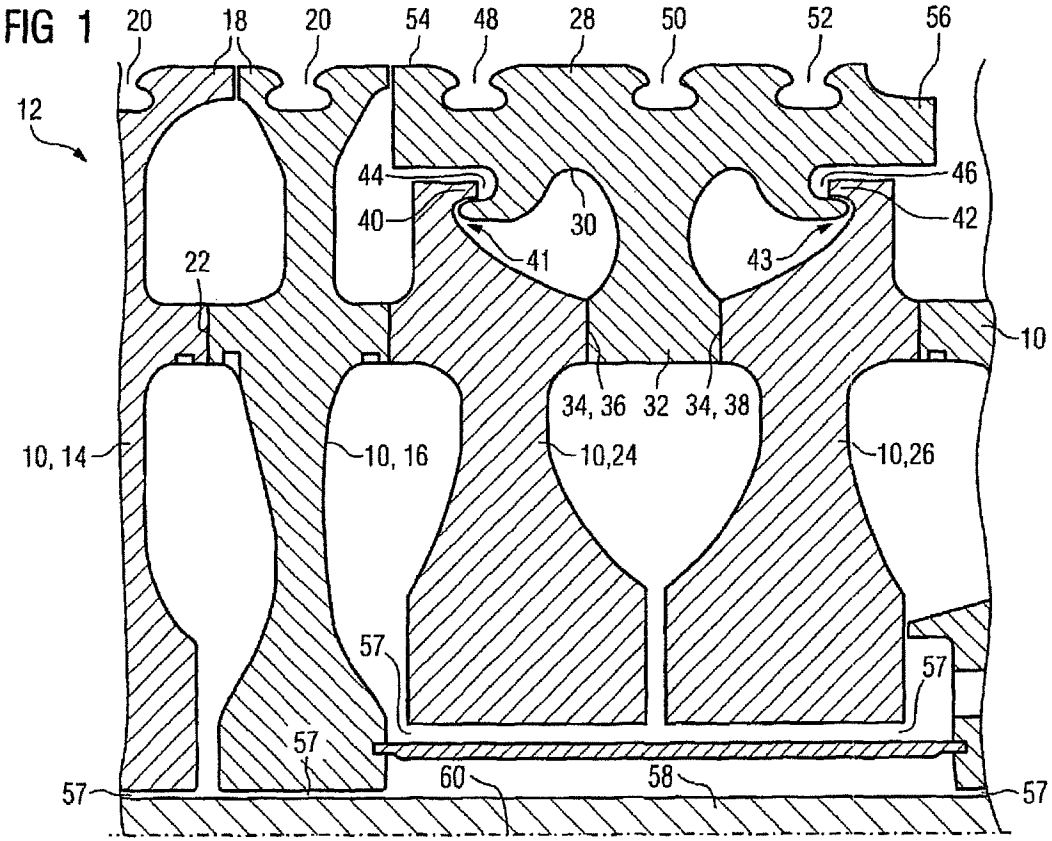
FIG. 1 shows a detail through the longitudinal section through a rotor according to the invention.

FIG. 1 shows a detail through the longitudinal section of a rotor 12, comprising a plurality of rotor disks 10, of a gas turbine which is not shown in more detail. The detail of the rotor 12 is selected in this case so that this lies in the high-pressure region of the axial compressor of the gas turbine. The delivery direction of the axial compressor is from the left-hand side of the drawing to the right-hand side of the drawing.

The rotor disks 14, 16 are manufactured in a known configuration and on their outer peripheries 18 have in each case a circumferential slot 20 which extends in the circumferential direction and are intended for accommodating rotor blades of the compressor. The rotor disks 14, 16 abut in a flange-like manner against a contact face 22, wherein in this contact face 22 provision is made for a Hirth toothing for the form-fitting connection.

Figure 2:
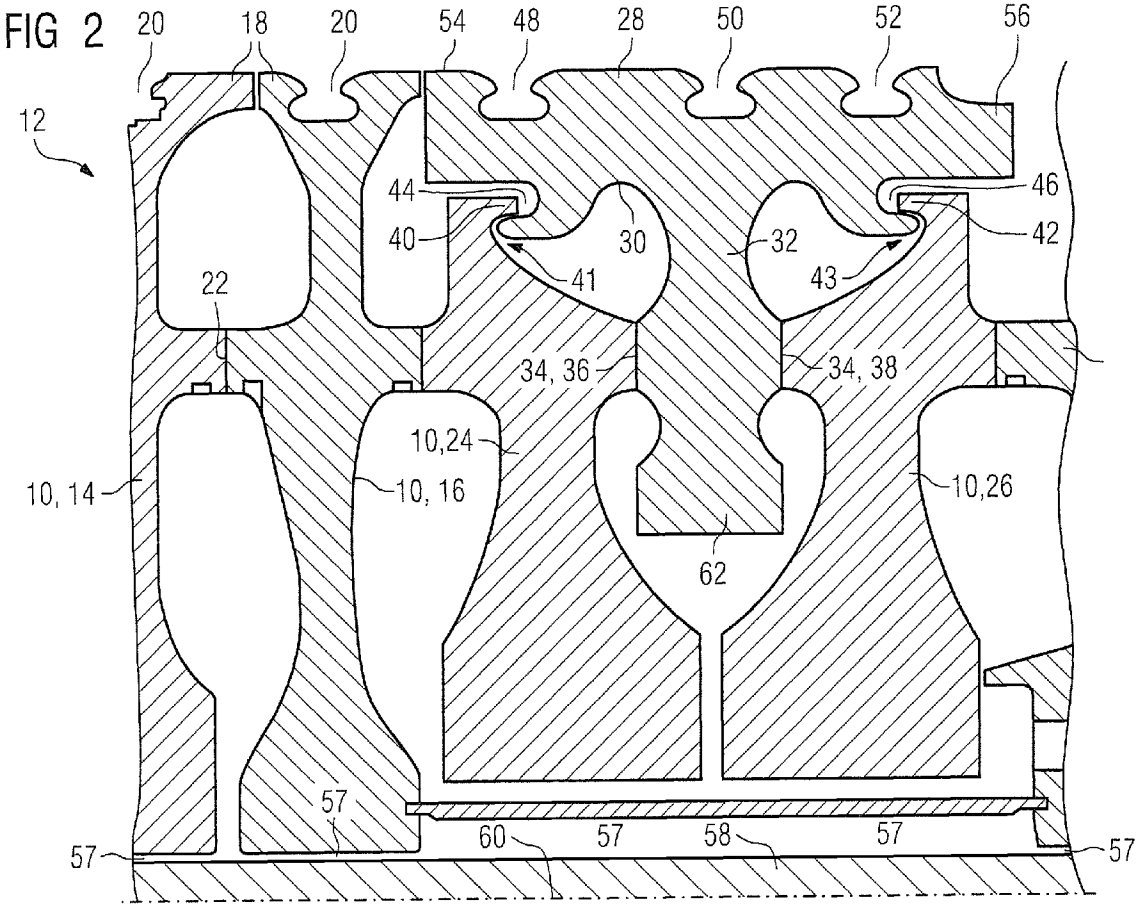
FIG. 2 shows the same detail as FIG. 1 with a modified drum.

Directly downstream of the rotor disk 16, that is to say shown further to the right in FIG. 2, provision is made for two further rotor disks 24, 26 which, compared with the rotor disks 14, 16 which are upstream of them, have a significantly smaller outside diameter. The terms "downstream" and "upstream" refer in this case to the direction of the compressed air which flows in the axial compressor.

The two rotor disks 24, 26 are encompassed by a drum 28 which in longitudinal section is T-shaped and in cross section circular. The drum 28 on its inner side 30 has a radially inwardly oriented, endlessly encompassing web 32 which is provided with two end faces 34 which lie opposite each other. The end faces 34 in this case abut by contact faces 36, 38 against the rotor disk 24 on one side and against the rotor disk 26 on the other side. The contact faces 36, 38 are structured in such a way that a form fit in the faun of a Hirth toothing is provided in each case.

Each of the rotor disks 24, 26 in their outer region have an encompassing hook 40, 42 which extends in the axial direction. Consequently, a circumferential slot 41, 43, which is open towards the end face, is created in each case. The annular hook 40, 42 engages in each case in an endlessly encompassing slot 44, 46 which is open towards the end face of the drum 28 and arranged in the said drum. The slots 44, 46 therefore form in each case a socket for the hooks 40, 42 which are arranged on the rotor disks 24, 26.

On its outer side, the drum 28, moreover, has rotor blade retaining slots 48, 50, 52 which extend in the circumferential direction, in which rotor blades of a blade ring can be inserted in each case. For this purpose, the rotor blades have blade roots which are formed corresponding to the rotor blade retaining slots 48, 50, 52. The rotor blades which can be inserted in the slots 48, 50, 52 are associated with the blade stages which carry out the last pressure increases in the medium which is to be compressed. The last three compressor blade rings of the compressor are arranged corresponding to the rotor blade retaining slots 48, 50, 52. On account of the high temperatures in the region of the drum 28 which occur during compression of the medium (air) the drum is manufactured from a more heat-resistant material than the rotor disks 24, 26 which are encompassed by the drum 28 and therefore lie radially further inside. The rotor disks 24, 26 can therefore be manufactured from a less temperature-resistant material since in their region lower temperatures occur than in the region of the drum 28. Furthermore, the axial distance between the slots 48 and 50 and also between the slots 50 and 52 is smaller in comparison than the distance when using three individual rotor disks instead of the drum 28 so that axial installation space in the compressor can be saved. The saving of axial installation space altogether enables the construction of a more cost-effective gas turbine or the construction of a more cost-effective compressor.

Although the drum 28 is formed in one piece and consequently is centered by the rotor disks 24, 26 which are provided therein, it has been proved to be advantageous for each of the rotor disks 24, 26 to be hooked into the inner side 30 of the drum 28. Even a slight raising of the two ends 54, 56 of the drum 28 which lie axially opposite each other can therefore be avoided. At the same time, the mechanical centrifugal force loads which originate from the rotor blades can be at least partially transmitted from the drum 28 onto the rotor disks 24, 26 so that the mechanical loads at the edge of the drum 28 remain within the permissible limits of the drum material.

Instead of a tie rod 58 which extends centrally through the hub openings 57 of the rotor disks 10, a number of tie rods which are arranged concentrically around the machine axis 60 in a decentralized manner can naturally also be provided in order to press the rotor disks firmly against each other.

FIG. 2 shows the same detail from the gas turbine as FIG. 1, wherein the same components are labeled with identical designations.

In contrast to FIG. 1, the drum 28 which is shown in FIG. 2 has a modified web 32. The web 32 according to the second configuration of the drum 28 which is shown in FIG. 2 extends inwards not only as far as those end faces 34 which abut against the contact faces 22 of the adjacent rotor disks 24, 26, but extends beyond this region. Therefore, the web 32 can also comprise a further hub region 62, the radial end of which lies significantly further inside than the contact faces 22 of the rotor disks 24, 26. As a result of this, a greater load-bearing capacity of the drum 28 can be achieved.

Figure 3:
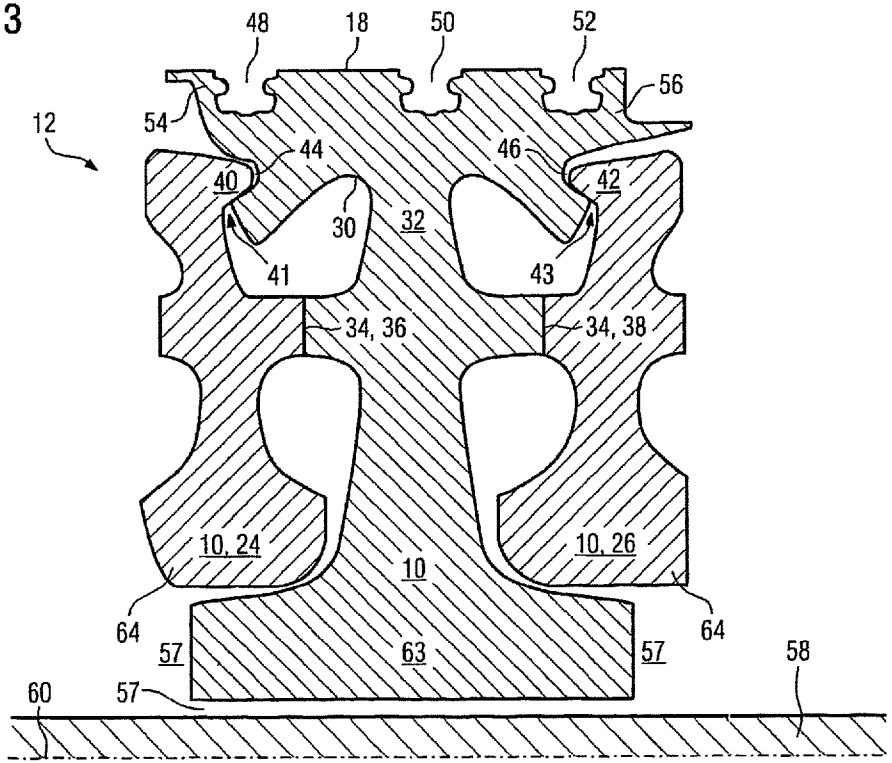
FIG. 3 shows a drum according to a further development with a radially inwards projecting hub region.

In FIG. 3, a further alternative development of the invention is shown, wherein identical features are provided with identical designations. Identical features, moreover, have the same function so that the previous description for identical construction features in FIG. 3 also applies here. Consequently, only the structural differences to FIG. 2 are then explained in more detail.

Compared with FIG. 2, the drum 28 according to FIG. 3 has a hub region 63 which projects even further radially inwards. This hub region 63, moreover, is also still of such width in its axial extent that this lies radially inside the hub regions 64 of the rotor disks 24, 26. In other words, the hub region 63 of the web 32 has such an axial extent that this extends partially into the hub opening 57 of the rotor disks 24, 26 with smaller diameter. By means of such a hub region 63 the mechanical stresses in the drum can be kept comparatively low, as a result of which this can also withstand the thermal loads in an improved manner.

In all, the invention therefore refers to a rotor 12 for a turbomachine, which is exposable to axial throughflow, with a plurality of rotor disks 10, 14, 16, 24, 26 which are arranged in a stacked manner, are clamped to each other by means of at least one tie rod 58, and have an outside diameter in each case. In order to disclose a particularly cost-effective rotor 12 in a compact type of construction, which in particular is designed for especially high pressure ratios with comparatively large compressor mass flows, it is proposed that at least one of the rotor disks 24, 26 of the rotor 12 has a smaller outside diameter than one of the adjacent rotor disks 16, and the existing diameter difference is compensated by means of a drum 28 which annularly encompasses the rotor disk 24, 26 with smaller outside diameter. In this case, only the drum 28 can be manufactured from a more heat-resistant material. The rotor disks 24, 26 which are encompassed by the drum, on the other hand, can be manufactured from a more cost-effective material which leads to cost saving. In addition, the drum 28 can carry at least one blade ring more than rotor disks 24, 26 which are encompassed by it.

The invention claimed is:

1. A rotor for a turbomachine which is exposable to an axial throughflow, comprising:

a plurality of rotor disks arranged in a stacked manner and which are clamped to each other using a tie rod, each rotor disk including an outside diameter, wherein at least two of the plurality of rotor disks includes a smaller outside diameter than one of the adjacent rotor disks and an existing diameter difference is compensated using a drum which annularly encompasses the two rotor disks with the smaller outside diameter, wherein an entire axial extent of the at least two rotor disks with the smaller outside diameter is encompassed by the drum, and wherein on an inner face of the drum there is an endlessly encompassing web which is axially clamped between the two encompassed rotor disks, wherein the web of the drum extends radially further inwards than the rotor disk with the smaller outside diameter, and wherein the web includes an axial width such that the web at least partially extends into a hub opening whereby the hub opening is a gap between the two rotor disks with the smaller outside diameter.

2. The rotor as claimed in claim 1, wherein a rotor disk with a larger outside diameter is arranged directly next to a rotor disk with a smaller outside diameter.

3. The rotor as claimed in claim 1, wherein the at least two rotor disks, as seen in an axial direction of the rotor, which are encompassed by the drum are hooked into the drum in order to absorb a plurality of centrifugal force loads.

4. The rotor as claimed in claim 3, wherein the at least two rotor disks, on a circumferential side of each rotor disk, have an annular hook which extends in the axial direction and engages in each case in a slot which is provided on the drum.

5. The rotor as claimed in claim 1, wherein the drum is formed from a more heat-resistant material than the rotor disk with the smaller diameter.

6. The rotor as claimed in claim 1, wherein the web includes a first set of two oppositely disposed, flange-like end faces which abut against a second and third set of flange-like end faces of the at least two adjacent rotor disks.

7. The rotor as claimed in claim 6, wherein the second and third set of end faces of the rotor disks and the first set of end faces of the web abut against each other in a form-fitting manner.

8. The rotor as claimed in claim 7, wherein the form fit is formed using a Hirth toothing.

9. The rotor as claimed in claim 1, wherein the drum includes a slot for accommodating a rotor blade.

10. The rotor as claimed in claim 9, wherein the slot is formed as a circumferential slot.

11. The rotor as claimed in claim 10, wherein a first number of circumferential slots is greater than a second number of rotor disks which are encompassed by the drum.

12. The rotor as claimed in claim 11, wherein an outer side of the drum accommodates a plurality of rotor blades which are arranged in a plurality of rings, and wherein a third number of rings which may be installed is greater than a fourth number of rotor disks which are encompassed by the drum.

13. A compressor, comprising:

a rotor, comprising:

a plurality of rotor disks arranged in a stacked manner and which are clamped to each other using a tie rod, each rotor disk including an outside diameter, wherein at least two of the plurality of rotor disks includes a smaller outside diameter than one of the adjacent rotor disks and an existing diameter difference is compensated using a drum which annularly encompasses the two rotor disks with the smaller outside diameter, wherein an entire axial extent of the at least two rotor disks with the smaller outside diameter is encompassed by the drum, wherein on an inner face of the drum there is an endlessly encompassing web which is axially clamped between the two encompassed rotor disks, wherein the web of the drum extends radially further inwards than the rotor disk with the smaller outside diameter, and wherein the web includes an axial width such that the web at least partially extends into a hub opening whereby the hub opening is a gap between the two rotor disks with the smaller outside diameter.

14. The compressor as claimed in claim 13, wherein a rotor disk with a larger outside diameter is arranged directly next to a rotor disk with a smaller outside diameter.

15. The compressor as claimed in claim 13, wherein the compressor includes a pressure ratio of more than 1:16.

16. The compressor as claimed in claim 13, where the compressor is the compressor of a stationary gas turbine used for power generation.

17. A gas turbine, comprising:

a compressor, comprising:

a rotor, comprising:

a plurality of rotor disks arranged in a stacked manner and which are clamped to each other using a tie rod, each rotor disk including an outside diameter, wherein at least two of the plurality of rotor disks includes a smaller outside diameter than one of the adjacent rotor disks and an existing diameter difference is compensated using a drum which annularly encompasses the two rotor disks with the smaller outside diameter, wherein an entire axial extent of the at least two rotor disks with the smaller outside diameter is encompassed by the drum, wherein on an inner face of the drum there is an endlessly encompassing web which is axially clamped between the two encompassed rotor disks, wherein the web of the drum extends radially further inwards than the rotor disk with the smaller outside diameter, and wherein the web includes an axial width such that the web at least partially extends into a hub opening whereby the hub opening is a gap between the two rotor disks with the smaller outside diameter.

18. The gas turbine as claimed in claim 17, wherein a rotor disk with a larger outside diameter is arranged directly next to a rotor disk with a smaller outside diameter.

19. The gas turbine as claimed in claim 17, wherein a nominal output of the gas turbine is more than 50 mega watts.

* * * * *